US007686321B2

(12) United States Patent
Cunningham et al.

(10) Patent No.: US 7,686,321 B2
(45) Date of Patent: Mar. 30, 2010

(54) HIGHBACK WITH TEXTILE-LIKE MATERIAL FOR SUPPORT

(75) Inventors: Christopher C. Cunningham, Burlington, VT (US); Bryan S. Davis, St. George, VT (US); Christopher M. Doyle, Bolton Valley, VT (US); Edward Giard, South Burlington, VT (US); Scott T. Keller, Waterbury, VT (US); Kahlil Zaloom, Essex Junction, VT (US)

(73) Assignee: The Burton Corporation, Burlington, VT (US)

( * ) Notice: Subject to any disclaimer, the term of this patent is extended or adjusted under 35 U.S.C. 154(b) by 479 days.

(21) Appl. No.: 11/607,826

(22) Filed: Dec. 1, 2006

(65) Prior Publication Data

US 2008/0129014 A1 Jun. 5, 2008

(51) Int. Cl.
*A63C 9/00* (2006.01)

(52) U.S. Cl. ..... 280/611; 280/617

(58) Field of Classification Search ..... 280/11.3, 280/611, 617, 618, 623, 634, 637
See application file for complete search history.

(56) References Cited

U.S. PATENT DOCUMENTS 2,240,532 A 5/1941 Warner
3,088,138 A 5/1963 Martin
3,235,978 A 2/1966 Hyde
3,761,981 A 10/1973 Frisbey
3,870,325 A 3/1975 Davis
4,154,009 A 5/1979 Kubelka et al.

(Continued)

FOREIGN PATENT DOCUMENTS

CA 1019145 4/1998

(Continued)

OTHER PUBLICATIONS

European Search Report for European Application No. 07023132, dated Mar. 4, 2008.

(Continued)

*Primary Examiner*—Lesley Morris
*Assistant Examiner*—John D Walters
(74) *Attorney, Agent, or Firm*—Wolf, Greenfield & Sacks, P.C.

(57) ABSTRACT

A highback is provided for controlling a gliding board, such as a snowboard, through leg movement of a rider. The highback is comprised of an upright support member to support a rear region of the rider's leg. The highback includes a textile-like material that extends across a portion of the support member to provide support for a portion of the rider's leg. The support member may have an opening therein with the textile-like material extending across the opening to assist in transmitting forces applied to that region of the support member as the rider presses against the highback during riding maneuvers. The textile-like material may help to distribute forces across a larger area of the rider's leg or boot so as to reduce pressure points against the rider's leg. The textile-like material may include one or more filaments, a fabric, or a fabric-like material that is coupled to the support member to support the rider's leg. The textile-like material may include a mesh fabric.

68 Claims, 6 Drawing Sheets

U.S. PATENT DOCUMENTS

| | | | | |
|---|---|---|---|---|
| 4,353,574 | A | 10/1982 | Faulin | |
| 4,367,885 | A | 1/1983 | Ramer | |
| 4,473,235 | A | 9/1984 | Burt | |
| 4,494,939 | A | 1/1985 | Calapp et al. | |
| 4,738,646 | A | 4/1988 | Ackert et al. | |
| 4,773,886 | A | 9/1988 | Teeter et al. | |
| 4,864,743 | A | 9/1989 | Begey et al. | |
| 4,907,354 | A | 3/1990 | Benoit et al. | |
| 5,329,706 | A | 7/1994 | Pozzobon | |
| 5,354,088 | A | 10/1994 | Vetter et al. | |
| 5,356,190 | A | 10/1994 | Torres | |
| 5,575,015 | A | 11/1996 | Paris et al. | |
| 5,575,091 | A | 11/1996 | Mattiuzzo | |
| 5,632,105 | A | 5/1997 | Bonaventure | |
| 5,690,351 | A | 11/1997 | Karol | |
| 5,718,066 | A | 2/1998 | Chemello et al. | |
| 5,727,797 | A | 3/1998 | Bowles | |
| 5,765,853 | A | 6/1998 | Erb | |
| 5,806,212 | A | 9/1998 | Benoit et al. | |
| 5,819,441 | A | 10/1998 | Perrissoud | |
| 5,901,469 | A | 5/1999 | Saillet | |
| 5,909,886 | A | 6/1999 | Tugutaka et al. | |
| 5,926,979 | A | 7/1999 | Borel | |
| 5,927,744 | A | 7/1999 | Knapschafer | |
| 5,947,487 | A | 9/1999 | Keleny et al. | |
| 5,957,479 | A | 9/1999 | Bayer et al. | |
| 5,967,531 | A | 10/1999 | Saillet | |
| 5,975,557 | A | 11/1999 | Snoke et al. | |
| 6,003,893 | A | 12/1999 | Hansen | |
| 6,009,639 | A | 1/2000 | Donnadieu et al. | |
| 6,027,136 | A | 2/2000 | Phillips | |
| 6,032,974 | A | 3/2000 | Saillet | |
| 6,065,770 | A | 5/2000 | Hansen et al. | |
| RE36,800 | E | 8/2000 | Vetter et al. | |
| 6,099,018 | A | 8/2000 | Maravetz et al. | |
| 6,105,993 | A | 8/2000 | Gignoux | |
| 6,109,643 | A | 8/2000 | Bayer et al. | |
| 6,116,635 | A | 9/2000 | Rigal | |
| 6,123,342 | A * | 9/2000 | Grell | 280/11.36 |
| 6,138,384 | A | 10/2000 | Messmer | |
| 6,155,577 | A | 12/2000 | Okajima | |
| 6,206,403 | B1 | 3/2001 | Black et al. | |
| 6,209,890 | B1 | 4/2001 | Couderc | |
| 6,231,057 | B1 | 5/2001 | Reuss et al. | |
| 6,254,111 | B1 | 7/2001 | Servant | |
| 6,273,450 | B1 | 8/2001 | Challande et al. | |
| 6,276,708 | B1 | 8/2001 | Hogstedt | |
| 6,283,495 | B1 | 9/2001 | Phillips | |
| 6,402,164 | B1 | 6/2002 | Gonthier | |
| 6,508,476 | B2 | 1/2003 | Joubert Des Ouches | |
| 6,520,511 | B2 | 2/2003 | Gonthier | |
| 6,543,793 | B1 | 4/2003 | Reuss et al. | |
| 6,557,865 | B1 | 5/2003 | Reuss et al. | |
| 6,604,746 | B1 | 8/2003 | Sato et al. | |
| 6,631,919 | B1 * | 10/2003 | West et al. | 280/633 |
| 6,729,642 | B2 | 5/2004 | Gouzes et al. | |
| 6,736,413 | B2 | 5/2004 | Laughlin et al. | |
| 6,886,850 | B2 | 5/2005 | Taylor et al. | |
| 6,945,543 | B2 | 9/2005 | De Bortoli et al. | |
| 7,011,334 | B2 | 3/2006 | Holzer | |
| 7,566,062 | B2 * | 7/2009 | Reuss et al. | 280/11.36 |
| 2002/0070530 | A1 | 6/2002 | Gouzes et al. | |
| 2003/0102652 | A1 | 6/2003 | Taylor et al. | |
| 2003/0141701 | A1 | 7/2003 | Holzer | |
| 2003/0146600 | A1 | 8/2003 | Holzer | |
| 2003/0193151 | A1 | 10/2003 | Reuss et al. | |
| 2004/0061311 | A1 | 4/2004 | DeBortoli et al. | |
| 2004/0145128 | A1 | 7/2004 | Couderc | |
| 2004/0232658 | A1 * | 11/2004 | Poscich | 280/618 |
| 2005/0057009 | A1 | 3/2005 | Couderc | |
| 2005/0167933 | A1 | 8/2005 | Couderc | |
| 2005/0280248 | A1 * | 12/2005 | Jean | 280/623 |
| 2005/0285372 | A1 | 12/2005 | Edmond | |
| 2007/0063459 | A1 * | 3/2007 | Kavarsky | 280/14.23 |

FOREIGN PATENT DOCUMENTS

| | | | |
|---|---|---|---|
| CA | 2171222 | | 8/1998 |
| DE | 198 54 705 | A1 | 6/1999 |
| DE | 198 02 304 | A1 | 7/1999 |
| DE | 198 36 554 | A1 | 1/2000 |
| EP | 0 838 248 | A1 | 10/1997 |
| EP | 0 858 818 | A1 | 2/1998 |
| EP | 0 898 990 | A1 | 3/1999 |
| EP | 0 933 100 | B1 | 8/1999 |
| EP | 1 120 138 | A1 | 8/2001 |
| EP | 1 228 789 | A1 | 8/2002 |
| EP | 1 371400 | A1 | 12/2003 |
| EP | 1 464 366 | A2 | 10/2004 |
| FR | 2 720655 | A1 | 12/1995 |
| FR | 2 755 030 | A1 | 4/1998 |
| FR | 2 771648 | B1 | 6/1999 |
| FR | 2 820 047 | B1 | 8/2002 |
| FR | 2 853 557 | A1 | 10/2004 |
| FR | 2 871 069 | A1 | 12/2005 |
| JP | 3072825 | | 8/2000 |
| JP | 2001-070005 | | 3/2001 |
| JP | 3089802 | | 8/2002 |
| WO | WO 95/33534 | A1 | 12/1995 |
| WO | WO 97/28858 | A1 | 8/1997 |
| WO | WO 97/28859 | A1 | 8/1997 |
| WO | WO 00/21621 | A1 | 4/2000 |
| WO | WO 03/099396 | A1 | 12/2003 |
| WO | WO 03099396 | A1 | 12/2003 |

OTHER PUBLICATIONS

Japanese Utility Model Technical Evaluation for Japanese Application No. 2007-009252, dated Feb. 14, 2008.

English translation of Office Action dated Apr. 24, 2009 for Chinese Patent Application No. 200710168200.8 (8 pages).

2007 Burton CO2 Binding, 2007 Burton Dealerbook MNS Hardgoods (3 pages).

* cited by examiner

HIGHBACK WITH TEXTILE-LIKE MATERIAL FOR SUPPORT

BACKGROUND OF INVENTION

1. Field of Invention

The present invention relates generally to a highback for gliding sports and, more particularly, to a highback for snowboarding.

2. Discussion of Related Art

Snowboard binding systems for soft snowboard boots typically include an upright member, called a "highback" (also known as a "lowback" and a "SKYBACK"), that is contacted by the rear region of a rider's leg. The highback, which may be mounted to a binding or a boot, acts as a lever that helps transmit forces directly to and from the board, allowing the rider to control the board through leg movement. For example, flexing one's legs rearward against the highback places the board on its heel edge with a corresponding shift in weight and balance acting through the highback to complete a heelside turn.

Known highbacks generally include an upright support member formed with a pair of lateral ears that are employed to pivotally mount the highback in a heel-to-toe direction along a mounting axis that is transverse to the longitudinal axis of the binding or boot. In some instances, the highback may also be mounted for lateral rotation about a substantially vertical axis to accommodate a particular stance angle of the binding relative to the board.

Known highbacks are typically molded from a composite material and/or a plastic material. A highback formed from a composite material, while sleek and lightweight, is generally very stiff. In contrast, a highback formed from a more flexible plastic material generally is bulky and relatively heavy due to structural features typically molded into the highback that provide the necessary stiffness for force transmission.

It is an object of the present invention to provide an improved highback.

SUMMARY OF INVENTION

In one illustrative embodiment of the invention, a highback is provided for use with a gliding board component that interfaces with a rider's leg and is supportable by a gliding board. The highback comprises a highback body including an upright support member having a leg contact region. The leg contact region includes a textile-like material that comes into contact with and contributes to transmitting forces from a rider's leg during use.

In another illustrative embodiment of the invention, a snowboard binding highback comprises a highback body including an upright support member having a leg contact region to support a rear region of a rider's leg. The support member has an opening at the leg contact region and includes a fabric material extending across the opening to support and assist in transmitting forces from a portion of the rear region of the rider's leg that is to be located adjacent the opening during use.

In a further illustrative embodiment of the invention, a snowboard binding is provided for securing a snowboard boot to a snowboard. The snowboard binding comprises a base that is constructed and arranged to be mounted to a snowboard, and a highback mounted to the base. The highback includes an upright support member to support a rear region of a rider's leg. The support member has an open space therein and includes a textile-like material extending across the open space. The textile-like material is to be engaged by and to contribute to the transmission of forces from a portion of the rear region of the rider's during use.

BRIEF DESCRIPTION OF DRAWINGS

Various embodiments of the invention will now be described, by way of example, with reference to the accompanying drawings, in which.

DETAILED DESCRIPTION

Figure 1:
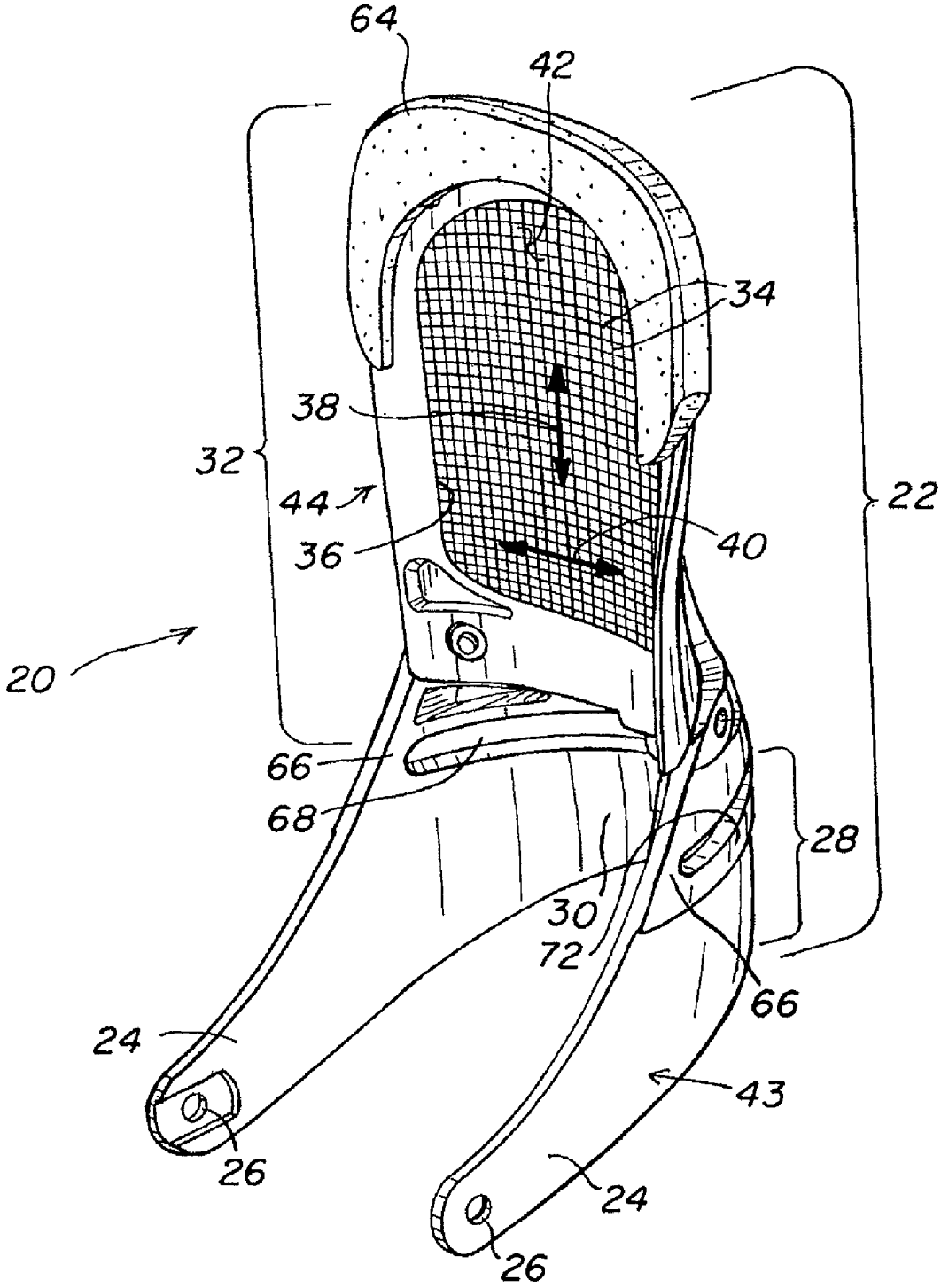
FIG. 1 is a front perspective view of a highback according to one illustrative embodiment of the invention.

The present invention is directed to a highback for controlling a gliding board, such as a snowboard, through leg movement of a rider. The highback may be used with a component, such as a gliding board binding, a boot or a binding interface, that interfaces with a rider's leg and is supportable by the gliding board. The highback is comprised of an upright support member to support a region of the rider's leg. The support member may include one or more mounting locations for mounting the highback to the gliding board component.

For purposes of this patent, "gliding board" refers generally to specially configured boards for gliding along a terrain such as snowboards, snow skis, water skis, wake boards, surf boards and other board-type devices which allow a rider to traverse a surface, and "gliding board component" refers generally to bindings, boots, binding interfaces or other components that may interface with a rider's foot or leg and be supportable by the gliding board.

The highback includes a textile-like material that extends across a portion of the support member to provide support for a portion of the rider's leg. The textile-like material provides support that allows the highback to function as a lever for transmitting forces to and from a board. More particularly, the textile-like material assists in transmitting energy or forces from a rider's leg to the gliding board during use of the highback. Without the textile-like material, the force transmission characteristics of the highback would change and may become less effective. In this regard, the textile-like material is a functional, and not merely a cosmetic, component of the highback.

The support member includes a leg contact region that is to be contacted by a portion of the rider's leg. The textile-like material may be provided at the leg contact region for direct contact with the portion of the rider's leg to assist in force transmission.

The textile-like material may be supported at the leg contact region so that at least a portion of the material is effectively suspended in relation to a support structure. In this regard, the material may be supported so that there is no direct support against the front and back sides or surfaces of the portion of the material. In certain embodiments, the textile-like material may provide a hammock-like arrangement for supporting the rider's leg.

The support member may have an open space or opening therein with the textile-like material extending across the opening for direct contact with a portion of the rider's leg or boot. The opening may include a hole or aperture that extends through the support member, an open-ended cavity or recess within the support member, or a space that exists between spaced apart support structures. The textile-like material may be tensioned across the opening or open space to help support the rider's leg or boot from pushing through the opening or between the spaced support structures as the rider presses against the highback to transmit forces for controlling the gliding board during riding maneuvers. The material also helps to distribute forces across the rider's leg or boot so as to reduce pressure points against the rider's leg.

The textile-like material may include one or more filaments, a fabric or a fabric-like material that has the appearance and properties of a fabric. The material may be relatively flexible and conformable as compared to other portions of the support member, such as rigid structural members, so that the material may readily conform to the rider's leg or boot for enhanced support and/or comfort. The textile-like material also provides a level of structural support that materially contributes to transmitting forces or energy from the rider's leg for controlling the gliding board during use.

One or more filaments may extend across the leg contact region or opening in one or more directions. In one embodiment, one or more filaments extend across the opening in a first direction and one or more filaments extend across the opening in a second direction that is transverse to the first direction. However, it is to be appreciated that filaments extending in different directions are not required for each embodiment of the highback. It is also to be understood that one filament may pass back and forth across the leg contact region or opening in one or more directions to effectively form multiple filaments or groups of filaments.

The filaments may employ various filament-like structures including, but not limited to, monofilament, multifilament, yarn, thread, string, cord and wire. The filaments may be fabricated from various materials including, but not limited to, plastic, metal and textile materials. The filaments may be selected to provide various characteristics including, but not limited to, strength, resiliency, flexibility, elasticity and/or stretch characteristics. The highback may employ all the same types of filaments or various combinations of different filaments to achieve desired support characteristics or properties. It is to be understood, however, that the use of filaments is not required for each embodiment of the highback.

The textile-like material may include a fabric that is coupled to the support member to support the rider's leg. The fabric may include textile fabrics, such as woven, non-woven, knitted or braided fabrics. The fabric may include one or more filaments that are fabricated into the fabric. In one embodiment, the fabric may be a mesh fabric. It is to be understood, however, that the use of a mesh fabric is not required for each embodiment of the highback.

The textile-like material may include a fabric-like material that is coupled to the support member to support the rider's leg. The fabric-like material may have the appearance and properties of a textile fabric. In this regard, the fabric-like material may have flexibility, conformability and supportive properties similar to those of a textile fabric. For example, the textile-like material may include a molded fabric-like material or a finely fenestrated screen. It is to be understood, however, that the use of a fabric-like material is not required for each embodiment of the highback.

The textile-like material may be coupled to the support member using various attachment or fastening techniques. Such techniques may include, but are not limited to, molding, gluing, bonding, stapling, stitching, lacing and stringing. In one embodiment, the material is overmolded to a portion of the highback.

The highback may be provided with an opening or open space to reduce the overall weight of the highback. The size of the opening may vary depending on the amount of weight reduction and the degree of structural support desired for the highback. In one embodiment, the opening has an area of at least 20 $cm^2$. It is to be understood, however, that an opening having such a minimum area is not required for each embodiment of the highback and that openings having other sizes are contemplated.

The highback has an inner surface that is engaged by the rear of the rider's leg and/or boot for transmitting forces. In one embodiment, the opening is at least 12% of the inner surface area of the highback. It is to be understood, however, that this particular ratio of the opening to the inner surface area is not required for each embodiment of the highback and that other ratios are contemplated.

In one illustrative embodiment as shown in FIGS. 1-4, the highback 20 includes an upright support member 22 and a pair of lateral ears 24 disposed on opposing sides of the support member. The lateral ears 24 provide mounting locations 26 that may be employed to attach the highback to a gliding board component, such as a snowboard binding, a snowboard boot or a binding interface. The lateral ears 24 may be configured to have any shape suitable for the particular mounting arrangement for the highback.

The support member 22 preferably has a contoured configuration that is compatible with the shape of a rider's leg (with or without footwear, such as a boot, depending upon the riding application). The support member 22 may include a lower portion 28 with a heel cup 30 that is configured to grip and hold the heel portion of the boot. As shown, the lateral ears extend from opposing sides of the heel cup 30. The support member 22 may also include an upper portion 32 that is configured to extend along and to be contacted by a region of the rider's leg to provide support for turning and controlling the board.

The highback may include a textile-like material that extends across a leg contact region or portion of the support member to support a portion of the rider's leg. In one illustrative embodiment shown in FIGS. 1-2, the textile-like material includes a plurality of filaments 34 that extend across the upper portion 32 of the highback to be directly contacted by and support a portion of the rear region of the rider's leg. The filaments 34 provide support for the rider's leg that allows the highback to function as a lever for transmitting forces to and from a board. In this manner, the filaments materially contribute to transmitting forces or energy from the rider's leg to the gliding board during use.

The highback 20 may be provided with one or more open spaces or openings to reduce the overall weight of the highback. In one illustrative embodiment shown in FIGS. 1-5, an opening 36 is provided in the upper portion 32 of the highback. A plurality of filaments 34 extend across the opening 36 to support a portion of the rider's leg or boot that will be positioned at the opening. In this manner, the filaments 34 help support the portion of the rider's leg or boot from pushing into or through the opening 36 as the rider presses against the highback and assist in transmitting forces from the rider's leg during riding maneuvers. The filaments 34 also help to distribute forces across the rider's leg or boot so as to reduce pressure points against the rider's leg.

As illustrated, the opening may extend completely through the upper portion of the highback so as to form an aperture or hole. It is to be appreciated, however, that the opening may not extend entirely through the highback and may include a cavity, a recess or similar feature that has an open end with the textile-like material extending across the open end of such a feature.

The filaments 34 may extend across the opening 36 in one or more directions. In one illustrative embodiment, the filaments include one or more filaments that extend across the opening in a first direction 38 and one or more filaments that extend across the opening in a second direction 40 that is transverse to the first direction. As shown, the filaments may extend across the opening in directions that are perpendicular to each other. However, it is to be appreciated that the filaments 34 may include filaments that extend in a single direction, such as vertically, horizontally or diagonally, across the opening. It is also to be appreciated that filaments may extend across the opening in any desired transverse directions. It is also to be understood that one filament may extend back and forth across the leg contact region or opening in one or more directions to effectively form multiple filaments or groups of filaments.

The highback 20 may employ one or more filaments, a fabric or a fabric-like material that is incorporated in the support member to support the rider's leg. In one illustrative embodiment, a sheet or layer of fabric 42 is coupled to the support member 22 and extends across the opening 36 to provide rider support. The fabric may be fabricated from a plurality of filaments 34. The fabric 42 may be formed using various techniques including, but not limited to, weaving, knitting, braiding and non-woven techniques. In one embodiment, the highback employs a mesh fabric. The highback may employ various fabric patterns and/or filaments to provide different support characteristics at different locations.

The fabric 42 may have one or more properties including, but not limited to, strength, tear resistance, abrasion resistance, water resistance and UV resistance properties, as would be suitable for the particular application.

In one illustrative embodiment, the mesh fabric 42 is woven from nylon PA6 (polyamide) monofilaments. However, the fabric 42 or individual filaments 34 may employ other filament-like structures including, but not limited to, multifilament, yarn, thread, string, cord and wire. The filaments 34 may be fabricated from various materials including, but not limited to, plastic, metal and textile materials. The highback may employ all the same types of filaments or various combinations of different filaments to achieve desired support characteristics or properties.

As indicated above, the highback may be provided with one or more openings to reduce the overall weight of the highback. The size of the opening may vary depending on the amount of weight reduction and the degree of structural support desired for the highback.

In the illustrative embodiment as shown in FIGS. 1-5, the opening 36 is relatively large and eliminates a substantial portion of the inner surface of the support member that would otherwise be available for supporting the rider's leg. The filaments 34 or fabric 42 may be tensioned across the opening 36 to assist in transmitting forces that are applied to that region of the highback. In one embodiment, the filaments 34 extend across the opening 36 to form a continuation of the inner surface of the support member. In this manner, the filaments 34 function as part of the inner surface of the highback for engaging with and supporting the rider's leg.

In one illustrative embodiment, the highback 20 employs a textile-like material as support across an opening 36 having an area of at least 20 $cm^2$. In another embodiment, the area of the opening is at least 25 $cm^2$. In another embodiment, the area of the opening is at least 30 $cm^2$. In a further embodiment, the opening has an area of at least 35 $cm^2$. In another embodiment, the area of the opening is at least 40 $cm^2$. In a further embodiment, the area of the opening is at least 45 $cm^2$. In another embodiment, the opening has an area of at least 50 $cm^2$. In a further embodiment, the opening has an area of at least 60 $cm^2$. It is to be understood, however, that the highback 20 may employ filaments 34 as a support across an opening having other minimum areas and that openings having other sizes are contemplated.

In one illustrative embodiment, the highback employs a textile-like material as support across an opening that occupies at least 12% of the inner surface area. In another embodiment, the opening occupies at least 15% of the inner surface area. In another embodiment, the opening occupies at least 19% of the inner surface area. In a further embodiment, the opening occupies at least 22% of the inner surface area. In another embodiment, the opening occupies at least 25% of the inner surface area. In a further embodiment, the opening occupies at least 28% of the inner surface area. In another embodiment, the opening occupies at least 31% of the inner surface area. In a further embodiment, the opening occupies at least 38% of the inner surface area. In determining the ratio of the opening 36 to the inner surface area of the highback, the inner surface area includes the inner surface areas of the heel hoop 30 and the upper portion 32 of the back member 22 and the areas of any openings 36 within the back member of the highback. It is to be understood, however, that these minimum ratios of the opening to the inner surface area are not limiting for each embodiment of the highback and that other ratios are contemplated.

The highback 20 may include a single support structure or multiple structures that are combined to form the highback. In one illustrative embodiment shown in FIGS. 1-4, the highback includes a first or lower frame 43 and a second or upper frame 44 that is mounted to the first frame 43. The lower frame 43 is configured to be mounted to the gliding board component. The upper frame 44 is configured to form part of the upper portion 32 of the highback that is to be engaged by and support the rider's leg. In certain embodiments, the upper frame forms a curved or concave contact surface.

Figure 2:
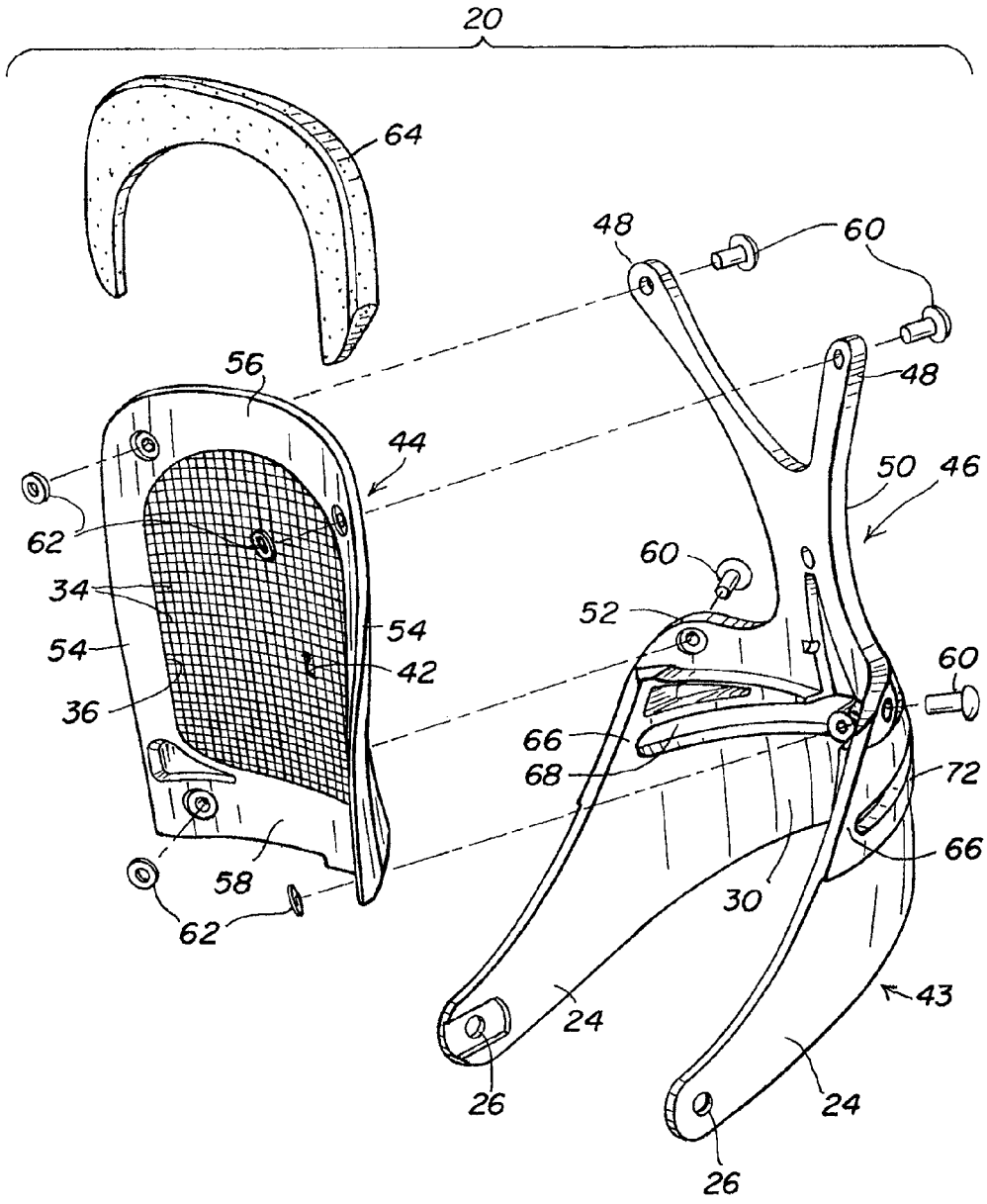
FIG. 2 is an exploded perspective view of the highback of FIG. 1.

In one illustrative embodiment as best shown in FIG. 2, the lower frame 43 includes the heel cup 30 and the lateral ears 24 extending from opposite sides of the heel cup. The lower frame 43 also includes an upwardly extending spine structure 46 that is configured to support the upper frame 44 and transmit forces applied to the upper frame into the gliding board component. The spine structure 46 combines with the upper frame 44 to form the upper portion 32 of the highback.

In one illustrative embodiment, the spine 46 is configured to provide the highback with progressive flex along the vertical direction of the highback. In this regard, the highback is configured so that it has a higher degree of flexibility at its upper end that decreases to a lower degree of flexibility at its lower end. As shown, the spine 46 includes a pair of elongated fingers or branches 48 that extend upwardly from a central portion or trunk 50 of the spine, which extends upward from a base portion 52 of the spine. As shown, the branches 48, which are relatively narrow and flexible, transition into a wider, more rigid trunk 50 which transitions into an even wider, more rigid base 52. In this manner, the flexibility of the spine 46 progressively decreases from the branches to the trunk and into the base of the spine.

As shown, the branches 48 are configured to support the upper region of the upper frame 44. The base 52 of the spine is configured to support the lower region of the upper frame.

Figure 5:
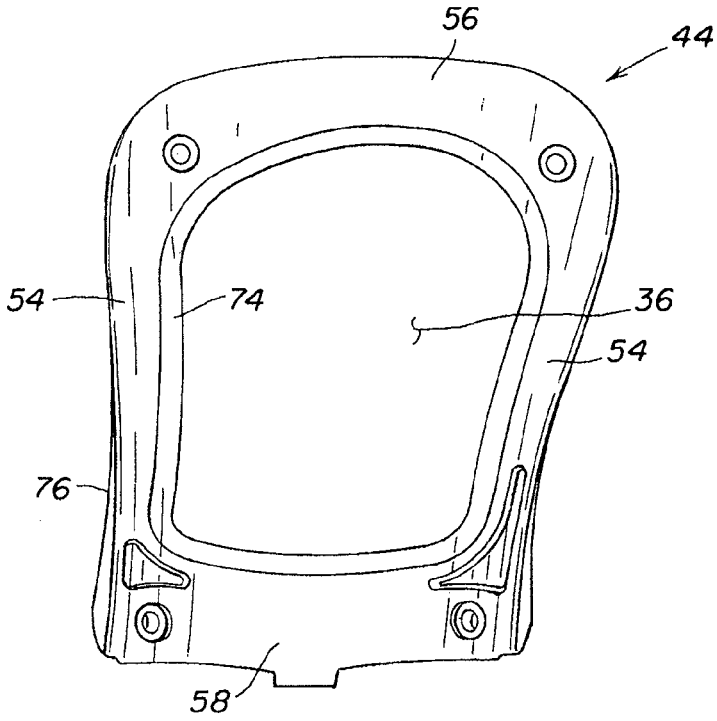
FIG. 5 is a front elevation view of the upper frame for the highback of FIGS. 1-2 shown without filaments across the opening.

The upper frame 44 may include one or more frame members for supporting the filaments. In one illustrative embodiment as best shown in FIG. 5, the upper frame 44 includes a pair of side members 54, a top member 56 and a bottom member 58. As shown, the top and bottom members 56, 58 are connected to the ends of the side members 54 to form a picture frame-like configuration that surrounds the opening 36. It is to be appreciated that the upper frame 44 may be configured so that it does not completely encompass or surround the opening 36. For example, the upper frame 44 may include side members 54 only, or the upper frame may include side members 54 that are connected with either a bottom member 58 or a top member 56.

In the illustrative embodiment, the upper frame 44 is formed as a single, unitary structure. However, it is to be understood that separate side, top and/or bottom members may be attached or connected together to form the upper frame.

In one illustrative embodiment, the upper frame 44 is attached to the lower frame 43 using mechanical fasteners. As shown, each corner region of the upper frame 44 is secured to the spine 46 of the lower frame with a fastener. In one embodiment as best shown in FIG. 2, the fasteners include rivets 60 and washers 62 that grip the frames 43, 44 together. However, it is to be understood that the upper frame 44 may be mounted to the lower frame 43 using any suitable arrangement as would be apparent to one of skill in the art.

Figure 3:
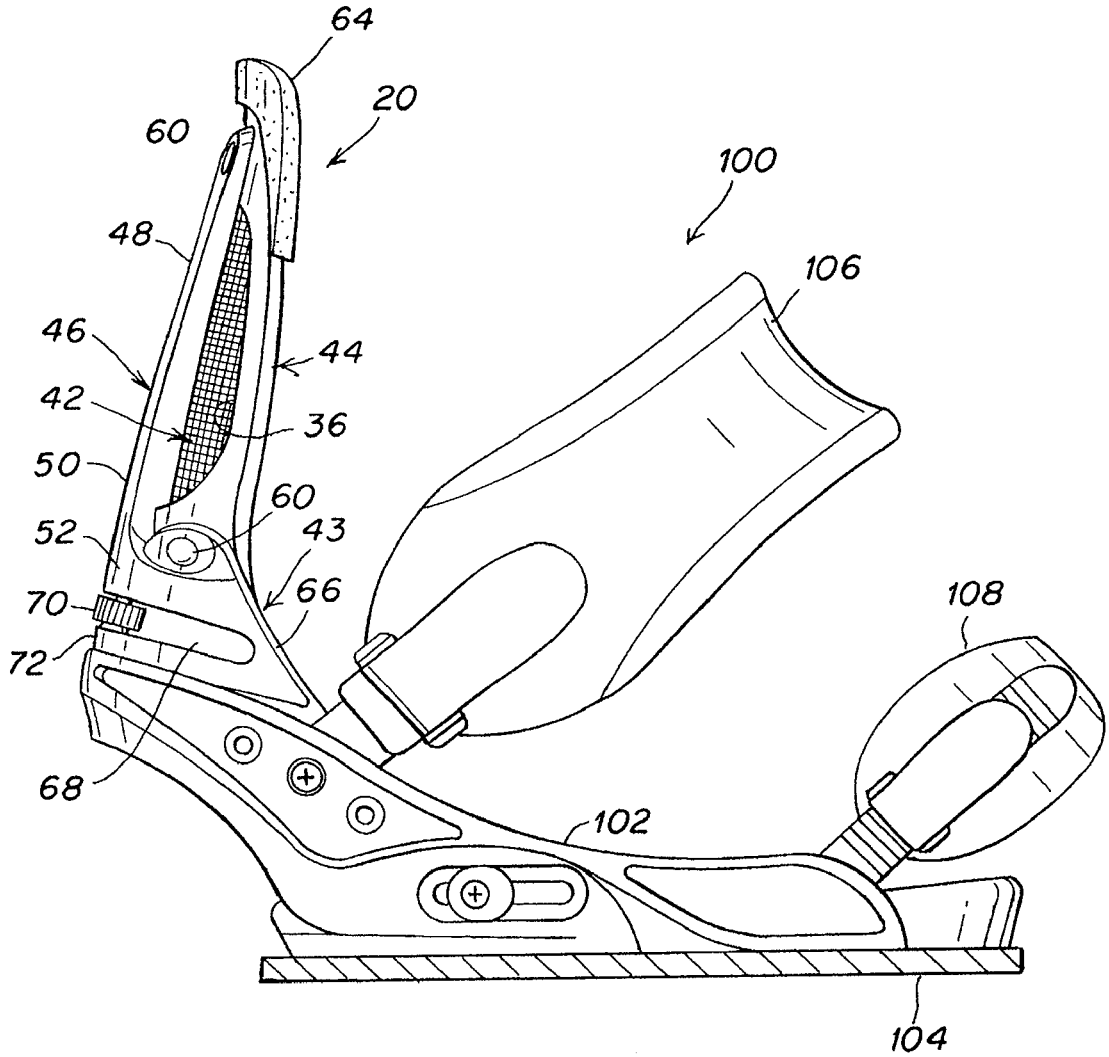
FIG. 3 is a perspective view of the highback of FIGS. 1-2 incorporated with an illustrative embodiment of a snowboard binding according to another aspect of the invention.

In one illustrative embodiment as best shown in FIG. 3, the highback 20 is configured so that the upper frame 44 supports the textile-like material in spaced or suspended arrangement relative to the spine 36. This arrangement allows the material to flex or deflect rearwardly, if desired, without interference from the spine. In this manner, the highback 20 employs a hammock-like configuration for supporting the textile-like material that may enhance the comfort of the highback.

A resilient pad may be provided to increase hold, to absorb shock and to facilitate pressure distribution across the boot and leg. In one illustrative embodiment as shown in FIGS. 1-2, a pad 64 is provided along the upper margin of the highback.

The highback 20 may be configured so that the upper portion 32 is adjustable in a heel-to-toe direction to allow for adjustment of the forward lean of the highback that is independent of the lower portion 28. More particularly, the forward lean of the highback may be adjusted without an accompanying movement of the lower portion 28 about a mounting axis of the highback. Consequently, the lower portion 28 may include a heel cup 30 that conforms closely to the shape of the boot for enhanced heel hold down, since the heel cup does not need to be configured to account for the up and down or pivoting movement of the lower portion 28 typically associated with forward lean adjustment of known highbacks.

In one illustrative embodiment shown in FIGS. 1-2, the highback 20 includes a hinge arrangement that allows the upper portion 32 to pivot, rotate or otherwise flex relative to the lower portion 28. It is to be appreciated, however, that the upper portion may be adjustably supported by the lower portion, if desired, using any suitable arrangement.

In one illustrative embodiment, the upper portion 32 is movably connected to the lower portion 28 using a living hinge 66 arrangement that is integrally formed in the lower frame of the highback. The living hinge 66 is formed at each end of a slot 68 by segments of the opposite edges of the lower frame that interconnect the spine 46 to the lower portion 28. It is to be understood that the spine 46 and the lower portion 28 may be hinged to each other using mechanical fasteners, such as pins, rivets, brackets and the like, that allow the spine, and consequently the upper portion, to pivot or otherwise move relative to the lower portion to facilitate forward lean adjustment. An example of a highback with independent forward lean adjustment is disclosed in U.S. Pat. No. 6,554,296, which is incorporated herein by reference.

Figure 4:
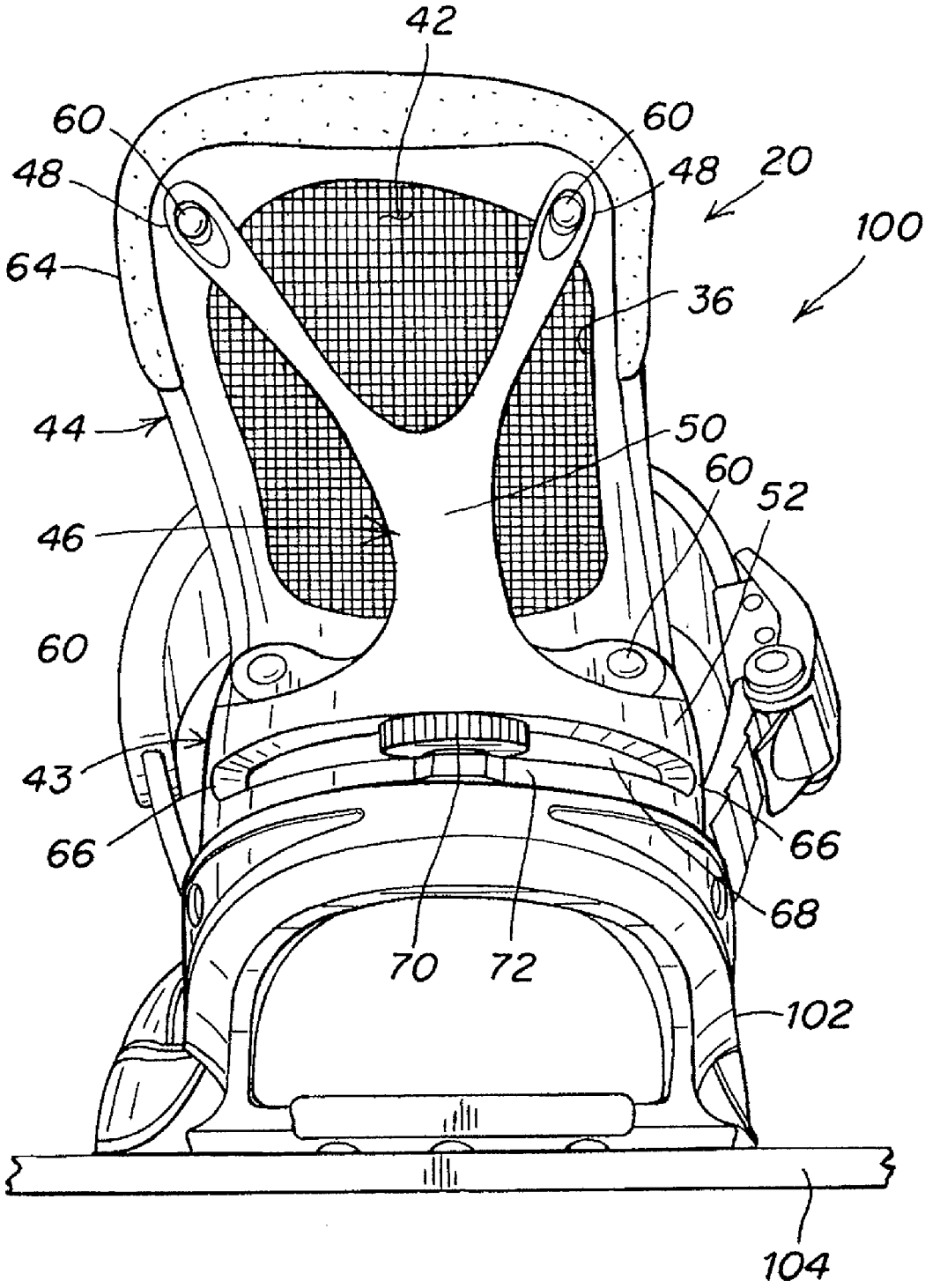
FIG. 4 is a rear view of the highback of FIGS. 1-2 incorporated with the snowboard binding of FIG. 3.

The forward lean of the highback 20 may be set using a forward lean adjuster that prevents the upper portion from moving in the heel direction beyond a predetermined forward lean position. In one illustrative embodiment as best shown in FIGS. 3-4, a forward lean adjuster 70 is coupled to the upper portion 32 of the highback to maintain the upper portion 32 in a selected forward lean position relative to the lower portion 28. The highback employs a screw-type forward lean adjuster 70 that allows a rider to adjust the forward lean of the highback simply by turning or rotating an actuator, such as a knob or wheel, by hand without the use of tools. As shown, the forward lean adjuster 70 is provided on the lower frame 43 and adjustably couples the spine 46 to the lower portion 28 of the frame. It is to be appreciated that other arrangements, such as those disclosed in U.S. Pat. No. 6,554,296, may be employed to adjust the forward lean of the highback.

Forces are transmitted to and from a board through the highback allowing a rider to control the board through leg movement. In one illustrative embodiment as best shown in FIGS. 3-4, the lower portion 28 of the back member includes a rearwardly extending abutment 72 that is configured to engage a portion of the gliding board component binding, such as a snowboard binding heel hoop, to transmit forces from the highback to the binding. The forward lean adjuster 70 is connected to the abutment 72 so that forces exerted against the upper portion 32 of the back member are at least partly transmitted through the forward lean adjuster 70 to the abutment 72 and into the heel hoop.

The upper and lower frames 44, 43 may be injection molded from a plastic material. In one embodiment, the upper and lower frames 44, 43 are molded as separate unitary structures that are subsequently combined to create the highback. Alternatively, the highback 20 may be fabricated as a unitary structure.

In one illustrative embodiment, a fabric 42 is molded to the upper frame 44. In particular, the fabric 42 is overmolded during fabrication of the upper frame. As shown in FIG. 5, the upper frame 44 includes an inner overmold frame 74 and an outer overmold frame 76. A layer of fabric 42 is initially overmolded with the inner overmold frame 74 which is subsequently overmolded with the outer overmold frame 76. In this regard, the fabric 42 may be tensioned and held within a first mold into which material may be injected to form an inner overmold frame subassembly. After the initial molding process, the inner overmold frame subassembly may be placed into a second mold into which material may be injected to form an outer frame around the inner frame and fabric resulting in the formation of the upper frame 44.

It is to be appreciated that the textile-like material may be coupled to the support member using other attachment or fastening techniques. For example, the material may be glued, bonded, stapled, stitched or laced to the upper frame 44 or to the back member 22 should the highback include a single frame structure. If individual filaments 34 are used as support across an opening, the filaments may be strung or laced to the support structure in a manner similar to stringing a racquet, such as a tennis racquet.

The highback 20 may be formed with any suitable material, including plastic materials such as nylon, polycarbonate, polyurethane, polyolefin, polyurethane and the like, that is capable of providing efficient force transmission from the rider to the board. In one embodiment, the lower frame 43 is fabricated from a nylon material, such as ZYTEL available from DuPont. In one embodiment, the upper frame 44 is fabricated from nylon materials. In particular, the inner overmold frame 74 is fabricated from a nylon resin, such as ZYTEL ST801, and the outer overmold frame 76 is fabricated from a glass reinforced nylon resin, such as ZYTEL 80G33.

It is also contemplated that the highback frames 43, 44 may be formed from two or more materials to provide varying degrees of stiffness throughout the highback.

While several examples are described above, it is to be appreciated that the highback may be fabricated with any suitable materials using any suitable manufacturing processes as would be apparent to one of skill in the art.

As indicated above, the support structure for the textile-like material does not need to completely surround the opening 36 or material extending across the opening. In another illustrative embodiment shown in FIGS. 6-7, a highback 80 includes a pair of upwardly extending side supports 82 that form the sides of the upper portion of the highback. As shown, the supports 82 are spaced apart with an opening or space 83 therebetween. One or more filaments 34 or a fabric 42 may be coupled to the supports 82 and tensioned across the opening 83 to provide support for a rider's leg. The highback provides a sling or hammock-like support for the rider's leg and/or boot.

As shown, the highback 80 does not include a heel cup formed by a plastic material as in known highbacks. Rather, the textile-like material extends into the lower portion of the highback to provide heel support for the rider. In this regard, the lower region 84 of the fabric 42 or other textile-like material acts as a heel cup for holding the heel portion of a boot. If desired, a heel hold down pad 86 may be provided at the lower end of the fabric.

Figure 7:
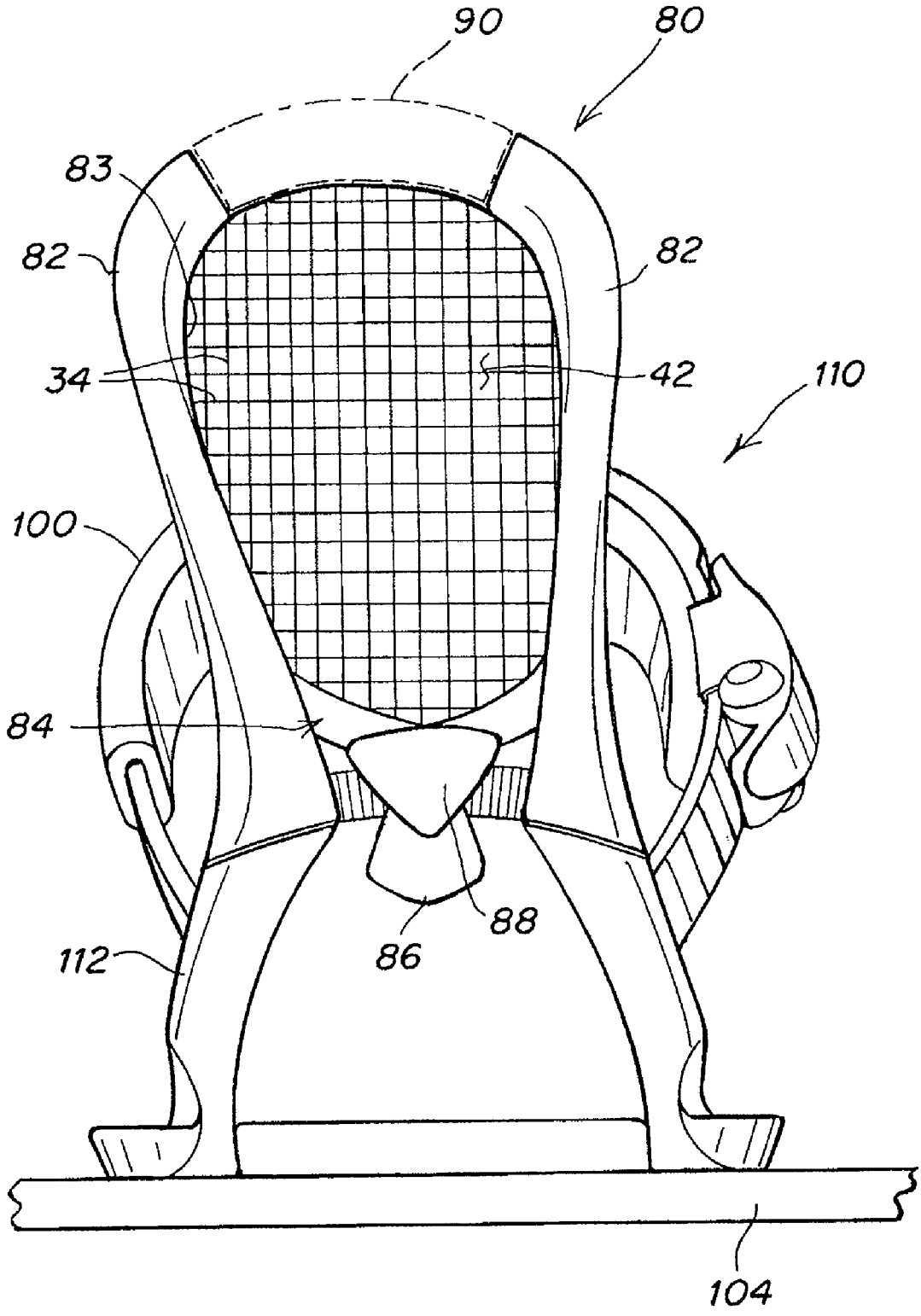
FIG. 7 is a rear view of the highback of FIG. 6.

It may be desirable to allow a rider to adjust the amount of support provided by the filament or fabric support of the highback. In one illustrative embodiment as shown in FIG. 7, the highback 80 includes a tension device 88 that allows the rider to adjust the amount of tension in the fabric 42 or other textile-like material for a desired amount of support. Adjusting the tension may allow the rider to select a desired amount of support provided by the highback to suit the rider's particular riding style. In this regard, adjusting the amount of support provided by the fabric 42 or filaments 34 may allow a rider to adjust the responsiveness and/or comfort of the highback. For example, a looser tension may allow the fabric to have a deep cup shape for receiving the rider's boot or leg, whereas a tighter tension may configure the fabric to have a shallower and more supportive configuration. It is to be appreciated, however, that a tensioning device is not required for the highback.

As shown in the illustrative embodiment, the upper end of the support fabric 42 is not supported by a structural cross member. This configuration may provide a higher degree of comfort and/or flexibility that may be desirable to a rider. This highback configuration may also be suitable for use with an adjustable width binding whereby the width of the highback may be adjusted in a corresponding manner. As the width of the highback is adjusted, the tension in the fabric may also be adjusted with the tension device 88.

For additional support, if desired, the highback 80 may include a top support member 90 (shown in phantom) that interconnects the upper ends of the side supports 82 and is coupled to the fabric 42.

The highback 20 may be employed in any gliding board activity, such as snowboarding, that would benefit from leg support. For ease of understanding, however, and without limiting the scope of the invention, the highback is now described below in connection with a snowboard binding.

In an illustrative embodiment shown in FIGS. 3-4, the snowboard binding 100 may include a base 102, which is mountable to a snowboard 104, and one or more binding straps, preferably adjustable straps, that are attached to the base for securing a boot (not shown) to the snowboard. The highback 20 is pivotally mounted to the base 102. As illustrated, the binding 100 may include an ankle strap 106 that extends across the ankle portion of the boot to hold down the rider's heel and a toe strap 108 that extends across and holds down the front portion of the boot. It is to be understood, however, that the binding 100 may employ other strap configurations.

Figure 6:
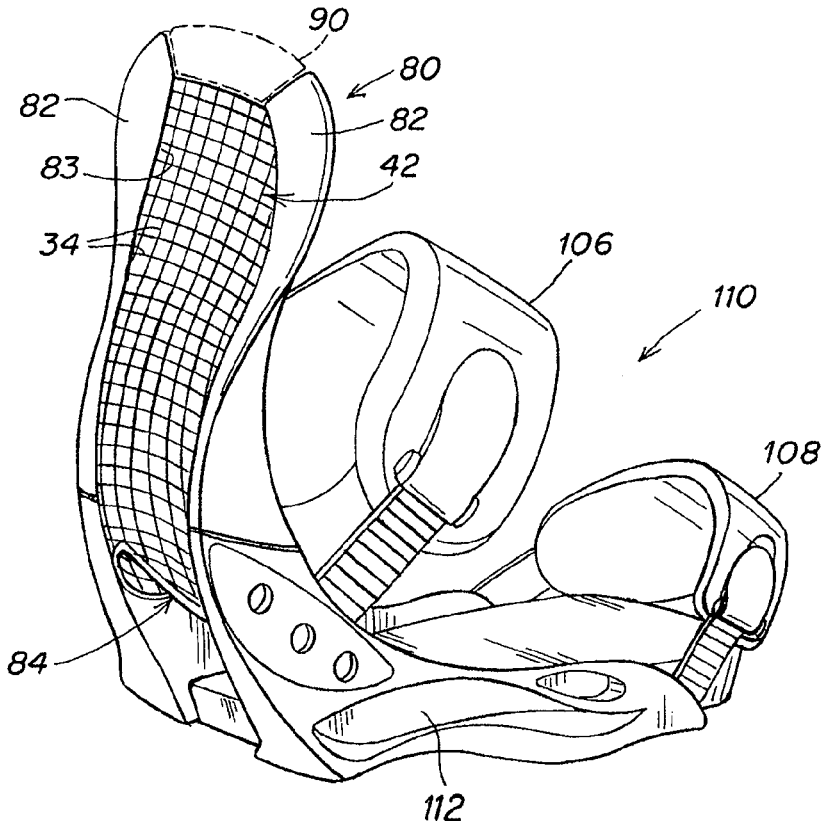
FIG. 6 is a perspective view of a highback according to another illustrative embodiment of the invention incorporated with an illustrative embodiment of a snowboard binding according to another aspect of the invention.

In another illustrative embodiment shown in FIGS. 6-7, the snowboard binding 110 may include a base 112 which lacks a heel hoop. The side supports 82 of the highback are pivotally mounted to the base 112. Forces are transmitted to and from the rider through the interaction between the side supports 82 and the base 112. The width of the base may be adjusted to conform to the particular size of a rider's foot or boot by adjusting the sides of the base toward or away from each other. Since the highback 80 includes a pair of rigid side supports 82 with no top and bottom structural supports therebetween, the width of the highback may be adjusted along with the base. The tension of the fabric support between the side supports may be adjusted to accommodate the particular width of the highback.

The highback, however, is not limited to use with any particular type of binding. For example, the highback may be used with a baseless binding. The highback may also be implemented with a step-in snowboard binding that includes a locking mechanism that engages corresponding features provided, either directly or indirectly, on a snowboard boot. Examples of several step-in bindings that may incorporate the highback are described in U.S. Pat. Nos. 5,722,680 and 6,123,354, which are incorporated herein by reference.

In another aspect, the highback may be either permanently attached to or removable from a snowboard boot. A removable highback provides system flexibility by allowing the boot to be implemented with binding systems that already include a highback mounted to a binding baseplate. In a further aspect, the highback may be implemented with a detachable binding interface system for interfacing a boot to a binding. Examples of employing a highback on a boot or with a detachable binding interface system are described in U.S. Pat. Nos. 6,543,793 and 6,554,296, which are incorporated herein by reference.

For ease of understanding, and without limiting the scope of the invention, the inventive highback to which this patent is addressed has been discussed particularly in connection with a binding that is used in conjunction with a snowboard. It should be appreciated, however, that the present invention may be used in association with other types of gliding boards. Thus, for purposes of this patent, "gliding board" refers generally to specially configured boards for gliding along a terrain such as snowboards, snow skis, water skis, wake boards, surf boards and other board-type devices which allow a rider to traverse a surface.

It should be understood that the foregoing description of various embodiments of the invention are intended merely to be illustrative thereof and that other embodiments, modifications, and equivalents of the invention are within the scope of the invention recited in the claims appended hereto.

What is claimed is:

1. A highback for use with a gliding board component that interfaces with a rider's leg, the highback comprising:

a highback body including an upright support member having a leg contact region, the leg contact region including a textile-like material that comes into contact with and contributes to transmitting forces from a rider's leg during use, the support member having an open space therein, the textile-like material extending across the open space to support a portion of the rear region of the rider's leg that is to be located adjacent the open space, the open space being located in an upper portion of the support member.

2. The highback according to claim 1, wherein the upper portion includes a calf portion, the open space being located in at least the calf portion of the support member.

3. The highback according to claim 1, wherein the support member includes at least two spaced apart side supports with the open space disposed therebetween, the textile-like material being coupled to the side supports and tensioned across the open space therebetween.

4. The highback according to claim 3, wherein the support member includes a top support that is coupled to upper ends of the side supports, the open space being disposed below the top support and the textile-like material being coupled to the top support.

5. The highback according to claim 3, wherein the textile-like material is molded to the side supports.

6. The highback according to claim 1, wherein the support member includes a support structure with the open space therein, the textile-like material being coupled to the support structure and extending across the open space.

7. The highback according to claim 6, wherein the textile-like material is molded to the support structure.

8. The highback according to claim 6, wherein the support structure extends about a portion of the open space.

9. The highback according to claim 8, wherein the support structure surrounds the entire open space.

10. The highback according to claim 1, wherein the textile-like material includes one or more filaments tensioned across the leg contact region.

11. The highback according to claim 10, wherein the one or more filaments include at least one filament that extends in a first direction.

12. The highback according to claim 11, wherein the one or more filaments includes at least one filament that extends in a second direction that is transverse to the first direction.

13. The highback according to claim 12, wherein the first direction is perpendicular to the second direction.

14. The highback according to claim 10, wherein the filaments include plastic filaments.

15. The highback according to claim 10, wherein the filaments include monofilaments.

16. The highback according to claim 1, wherein the textile-like material includes a fabric that is tensioned across the leg contact region.

17. The highback according to claim 16, wherein the fabric includes a woven fabric.

18. The highback according to claim 1, wherein the textile-like material includes a fabric-like material that is tensioned across the leg contact region.

19. The highback according to claim 1, wherein the open space has an area of at least 20 $cm^2$.

20. The highback according to claim 1, wherein the open space has an area of at least 30 $cm^2$.

21. The highback according to claim 1, wherein the open space has an area of at least 40 $cm^2$.

22. The highback according to claim 1, wherein the open space has an area of at least 50 $cm^2$.

23. The highback according to claim 1, wherein the support member includes an inner surface that is engageable with the rear region of the rider's leg, the open space occupying at least 12% of the inner surface of the support member.

24. The highback according to claim 1, wherein the support member includes an inner surface that is engageable with the rear region of the rider's leg, the textile-like material defining at least a portion of the inner surface.

25. The highback according to claim 1, wherein the highback is a snowboard binding highback that is mountable to a snowboard binding base.

26. A highback for use with a gliding board component that interfaces with a rider's leg, the highback comprising:

a highback body including an upright support member having a leg contact region to support a rear region of a rider's leg, the support member having an opening at the leg contact region and including a textile-like material extending across the opening to support and assist in transmitting forces from a portion of the rear region of the rider's leg that is to be located adjacent the opening during use, the textile-like material being fixed in tension across the opening.

27. The highback according to claim 26, wherein the upper portion of the support member includes a calf portion, the opening being located in at least the calf portion of the support member.

28. The highback according to claim 26, wherein the textile-like material is constructed and arranged to distribute forces and reduce pressure points between the support member and the rear region of the rider's leg.

29. The highback according to claim 26, wherein the textile-like material is fixedly tensioned to the upright support member.

30. The highback according to claim 29, wherein the support member includes spaced apart side supports with the opening disposed therebetween, the textile-like material being coupled to the side supports and tensioned across the opening between the side supports.

31. The highback according to claim 30, wherein the support member includes a top support that is coupled to upper ends of the side supports, the opening being disposed below the top support and the textile-like material being coupled to the top support.

32. The highback according to claim 26, wherein the support member includes a support structure with the opening therein, the textile-like material being coupled to the support structure and tensioned across the opening.

33. The highback according to claim 32, wherein the textile-like material is molded to the support structure.

34. The highback according to claim 32, wherein the support structure extends about a portion of the opening.

35. The highback according to claim 34, wherein the support structure surrounds the entire opening.

36. The highback according to claim 26, wherein the support member includes a first frame that is mountable to a snowboard binding base and a second frame coupled to an upper portion of the first frame, the textile-like material being coupled to the second frame.

37. The highback according to claim 36, wherein the opening is located in the second frame.

38. The highback according to claim 26, wherein the textile-like material includes at least one of one or more filaments, a fabric material and a fabric-like material.

39. The highback according to claim 26, wherein the textile-like material includes a mesh fabric.

40. The highback according to claim 26, wherein the opening has an area of at least 20 $cm^2$.

41. The highback according to claim 26, wherein the opening has an area of at least 30 $cm^2$.

42. The highback according to claim 26, wherein the opening has an area of at least 40 $cm^2$.

43. The highback according to claim 26, wherein the opening has an area of at least 50 $cm^2$.

44. A snowboard binding for securing a snowboard boot to a snowboard, the snowboard binding comprising:

a base that is constructed and arranged to be mounted to a snowboard; and a highback mounted to the base, the highback including an upright support member to support a rear region of a rider's leg, the support member having an open space therein and including a textile-like material extending across the open space, the textile-like material to be engaged by and to contribute to the transmission of forces from a portion of the rear region of the rider's leg during use, the open space being located in an upper portion of the support member.

45. The snowboard binding according to claim 44, wherein the upper portion of the support member includes a calf portion, the opening being located in at least the calf portion of the support member.

46. The snowboard binding according to claim 44, wherein the textile-like material includes one or more filaments.

47. The snowboard binding according to claim 44, wherein the textile-like material includes a mesh fabric.

48. The snowboard binding according to claim 47, wherein the mesh fabric includes woven filaments.

49. The snowboard binding according to claim 44, wherein the textile-like material includes a fabric-like material.

50. The snowboard binding according to claim 44, wherein the open space has an area of at least 20 $cm^2$.

51. The snowboard binding according to claim 44, wherein the open space has an area of at least 30 $cm^2$.

52. The snowboard binding according to claim 44, wherein the open space has an area of at least 40 $cm^2$.

53. The snowboard binding according to claim 44, wherein the open space has an area of at least 50 $cm^2$.

54. The snowboard binding according to claim 44, wherein the support member includes a support structure with the open space therein, the textile-like material layer being coupled to the support structure and tensioned across the open space.

55. The snowboard binding according to claim 54, wherein the textile-like material is molded to the support structure.

56. The snowboard binding according to claim 44, wherein the support member includes spaced apart side supports with the open space disposed therebetween, the textile-like material being coupled to the side supports and tensioned across the open space between the side supports.

57. The snowboard binding according to claim 44, further comprising at least one strap that is constructed and arranged to secure a snowboard boot.

58. The highback according to claim 26, in combination with a snowboard binding base that is constructed and arranged to be mounted to a snowboard, the highback being mounted to the snowboard binding base.

59. The combination according to claim 58, wherein the textile-like material includes at least one of one or more filaments, a fabric material and a fabric-like material.

60. The combination according to claim 58, wherein the textile-like material includes a mesh fabric.

61. The combination according to claim 60, wherein the mesh fabric includes woven filaments.

62. The combination according to claim 58, wherein the opening has an area of at least 20 $cm^2$.

63. A highback for use with a gliding board component that interfaces with a rider's leg, the highback comprising:

a highback body including an upright support member having a leg contact region to support a rear region of a rider's leg, the support member having an opening at the leg contact region and including a textile-like material extending across the opening to support and assist in transmitting forces from a portion of the rear region of the rider's leg that is to be located adjacent the opening during use, the textile-like material being fixed in place across the opening.

64. The highback according to claim 63, wherein the textile-like material includes at least one of one or more filaments, a fabric material and a fabric-like material.

65. The highback according to claim 63, wherein the textile-like material includes a mesh fabric.

66. The highback according to claim 65, wherein the mesh fabric includes woven filaments.

67. The highback according to claim 63, wherein the opening has an area of at least 20 $cm^2$.

68. The highback according to claim 63, in combination with a snowboard binding base that is constructed and arranged to be mounted to a snowboard, the highback being mounted to the snowboard binding base.

* * * * *